United States Patent [19]

Gallagher, Jr.

[11] Patent Number: 4,484,833

[45] Date of Patent: Nov. 27, 1984

[54] SUCKER ROD

[75] Inventor: Hugh M. Gallagher, Jr., Cincinnati, Ohio

[73] Assignee: Consolidated Metal Products, Inc., Cincinnati, Ohio

[21] Appl. No.: 307,190

[22] Filed: Sep. 30, 1981

[51] Int. Cl.[3] ..... B25G 3/34

[52] U.S. Cl. ..... 403/267; 403/266; 403/343

[58] Field of Search ..... 403/343, 342, 328, 322, 403/324, 325, 321, 306, 305, 301, 267, 266; 72/88, 198

[56] References Cited

U.S. PATENT DOCUMENTS

| | | | |
|---|---|---|---|
| 1,605,316 | 11/1926 | Wilson | 403/343 X |
| 1,671,458 | 5/1928 | Wilson | 403/343 |
| 1,753,638 | 4/1930 | Axtell | 228/161 |
| 1,932,427 | 10/1933 | Stone | 403/343 |
| 1,947,969 | 2/1934 | Browne | 29/447 |
| 2,751,194 | 6/1956 | Rohrback et al. | 403/343 |
| 3,405,592 | 10/1968 | Blodee | 403/267 X |
| 3,489,620 | 1/1970 | Current | 148/146 |
| 3,530,920 | 9/1970 | Podell | 72/88 X |
| 3,656,332 | 4/1972 | Marcovitch | 72/198 X |
| 3,763,909 | 10/1973 | Stover | 72/88 X |
| 3,850,215 | 11/1974 | Orlomoski | 72/88 X |
| 4,034,587 | 7/1977 | Schwarz | 72/198 X |
| 4,174,971 | 8/1979 | Strand | 411/301 |
| 4,205,926 | 6/1980 | Carlson | 403/343 X |
| 4,329,124 | 5/1982 | Pridy | 403/343 X |

OTHER PUBLICATIONS

Article from *National Machinery*, Tiffin, OH, (Reprint), "High-Speed Forging of Sucker Rods".

Publication of American Petroleum Institute, Washington, D.C., *Care and Handling of Sucker Rods.*

*Primary Examiner*—Andrew V. Kundrat

*Attorney, Agent, or Firm*—Wood, Herron & Evans

[57] ABSTRACT

A stronger, lighter sucker rod formed from cold-drawn medium to high carbon steel composed of three basic components which provide versatility in forming the sucker rod. A sucker rod is disclosed which is formed of machined, cold-drawn steel elements. The construction of the sucker rod significantly increases the resistance of the rod to metal fatigue and yields a rod which is smaller in diameter and lighter in weight than an equivalent strength rod made from hot rolled or heat treated steel metal stock.

20 Claims, 2 Drawing Figures

SUCKER ROD

BACKGROUND OF THE INVENTION

This invention relates to an improved sucker rod formed from cold-drawn steel.

In the field of oil well pumping, sucker rods are rods which are joined together to extend down an oil well hole for the purpose of operating a pumping mechanism at the bottom of the well. Individual rods typically of 25–30 feet in length, and ½ inch to 1¼ inch in diameter, are connected end to end to form a relatively straight line or string within the oil well hole. Reciprocating motion from a pumping unit on the surface is transmitted via the string to a subsurface pump located at the bottom of the well hole, the pump serving to force the oil up through the same well hole to the surface. A string of sucker rods can be of substantial length, extending several miles long when installed.

In general, a sucker rod is made from a single piece of steel which has been hot upset forged to form the pin or box end shapes, or from two machined or cast end portions and a rod body member which are combined, typically through the use of a screw fit, to form a sucker rod.

The joining of sucker rods forming a string is ordinarily done in two ways, i.e., both ends of the sucker rods can be externally threaded to form matching pin ends, with an internally match-threaded coupling element joining two adjacent sucker rods in end to end relationship; or the sucker rod can be made with a single externally threaded pin end and a box formed at the other end which is internally match-threaded, the box being adapted to cooperate with the pin of an adjacent rod to directly join the ends of the sucker rods together.

A sucker rod string is in a constant state of tension, alternating between compression forces on the downward stroke of the surface pump and load forces on the upward stroke. Because of the cyclical stressing of the joints between adjacent sucker rods and of the sucker rod itself, weak points along the string are subject to metal fatigue failures. These tension stresses are further aggravated by bending stresses associated with fluid pound which result in cracking of the steel rod material, as well as deterioration of the rods from corrosive materials in the wells, and abrasion of the rods against the well casing or tubing. In general, however, the load force imposed on the string is responsible for the ultimate failure of a sucker rod. A failure of a rod or coupling causing a separation of the string results in costly down-time of the well, as well as the difficult and time consuming task of fishing out the dissociated portion of the string and replacing the component which has failed.

The threads formed on a sucker rod are locations of high stress concentration due to their shape. During the operation of the well, high tensional pump forces are also transmitted through the engaged threads. The coupling point between adjacent sucker rods in a string is thus a principal location of stress concentration, and the stress points are multiplied in sucker rods which are composed of multiple elements where the joining points also become a focal area of stress forces. Considerable effort has thus been expended to produce a sucker rod which minimizes the sensitivity of these threaded coupling and joint areas to metal fatigue from pumping stresses which can result in weakness or failure of the total assembly.

Steel for sucker rods has generally been made by either open hearth or electric induction furnace hot forging processes. The hot rolled bars formed in these processes are sheared to length at a rolling mill and machine straightened. In making a sucker rod from a single bar, both ends of the bar are separately heated to around 2400° F., and upset forged to the pin or box shape required. For example, the upsetting process for a pin end would comprise forming a pin blank for the male end, gathering the metal into the pin shoulder and the wrench square shape, and forming the tapered bead or flare portion of the transition area between the sucker rod body and the upset end portion. This latter transition area is an area of high stress on the sucker rod. The sucker rod is then heat treated full length to improve tensile and yield strength, this treatment consisting of either normalizing, normalizing and tempering, or liquid quenching and tempering. The treated rods are then cleaned by shot or grit-blasting and the ends are machined and threaded.

Alternatively, it is known in the art to make a sucker rod from multiple elements of hot rolled steel. The hot rolled bars are sheared to length and machine straightened. Both ends of the bar are then externally threaded. Pin and box portions for the bar ends are either cast or machined to the proper shape, and internally threaded to match the ends of the bar. The appropriate end elements are then screwed on to the bar and torque fitted. The joint thus formed in the transition area between the sucker rod body and the end element is a weak point caused by both stress concentration and lack of fatigue resistance on this area.

SUMMARY OF THE INVENTION

It is thus a principal object of the present invention to provide an improved sucker rod which significantly increases the resistance of the rod to metal fatigue failure.

A further object is to provide a sucker rod with greater versatility through the employment of a multi-element construction.

Yet another object is to provide a sucker rod having greater tensile strength, thus providing a rod which can be made smaller and thus lighter than the standard rod currently being employed. Such a smaller, stronger sucker rod will consequently reduce the load imposed on the individual rods due to the overall reduction of the mass of the string; further the use of a smaller diameter rod increases the volume of oil which can be pumped through the well hole.

Broadly stated, this invention comprises the formation of a new and improved sucker rod from cold-drawn rather than hot rolled steel. A medium to high carbon cold-drawn steel is employed having a 135,000 minimum tensile strength and even 150,000 tensile strength, or higher, and having three to five times the fatigue life of standard heat-treated steel stock. Because of the higher tensile strength achieved through the use of cold-drawn rather than hot forged and/or heat treated stock material, a smaller diameter rod can be manufactured which will accomplish the same task as a larger rod. Use of a lighter rod results in a reduction in the weight of the sucker rod string and a consequent reduction in the size and horsepower of the equipment needed to reciprocate the string in the well. More importantly, the smaller diameter rod increases the volume available in the well casing for the passage of oil being pumped to the surface.

The sucker rod is formed of three principal elements which are cold-drawn and machined to specification rather than hot rolled or forged. The sucker rod consists of two machined end portions and an intermediate elongate rod body portion. The end portions consist of box and pin configurations which have been manufactured to API standard dimensions, having a wrench square and a tapered bead or flared portion at the transition area between the sucker rod body and the end portion. The male, or pin end, is provided with a pin shoulder. In assembled form, the rod will typically be provided with either a pin and pin end combination or a box and pin end combination. In the former combination, the rod will have an associated coupling element used to connect adjacent rods to form the sucker rod string. In the latter combination, the string is formed directly from coupling pin and box ends of adjacent rods together without any coupling element. The coupling element, like the other elements of the rod, is made of medium to high carbon steel which has been machined to API standard dimensions.

The various elements of the rod are roll threaded, the pin and box end portions having compatible exterior and interior threading, respectively, and the coupling elements having internal threads matching the external threads of the pin ends of the sucker rod.

The flared or tapered bead portion of each end element is machine bored along its central axis to provide a female receptacle for an end of the rod body member. The bore and rod body member are compatibly roll threaded.

In assembly, selected end portions are screwed on to a rod body member and torque fitted to provide a solid, strong connection in the transition zone formed between the flare portion of the end piece and the sucker rod body member. An anaerobic cement is preferably applied to this joint prior to assembly to bond the roll threads and thereby minimize or prevent weakness in the transition zone, prevent the ends from working loose, and seal the joints from the intrusion of oil or corrosive fluids.

The sucker rod of this invention further utilizes a novel collar on the flared or tapered portion of each end element that, in combination with the preferred cement, further eliminates stress concentrations in the transition zone by equalizing or distributing more evenly the load typically imposed on the first thread of the end bore.

The assembled rod can be provided with one or more paraffin scrapers, the scrapers being fixed along the surface of the rod body member. The scrapers serve to break up the build-up of paraffin on the well casing that solidifies out from the oil as the oil cools on its way to the surface. Such paraffin build-ups restrict the flow and volume of oil which can be pumped from the well.

The anaerobic cement preferably employed is of an increased viscosity that yields better adhesion in the transition zone joint with less run-off of the cement. This has been accomplished by increasing the percentage of thixotropic agent to yield a viscosity range of between 20,000–30,000 centipoise.

DETAILED DESCRIPTION OF THE DRAWINGS

Figure 1:
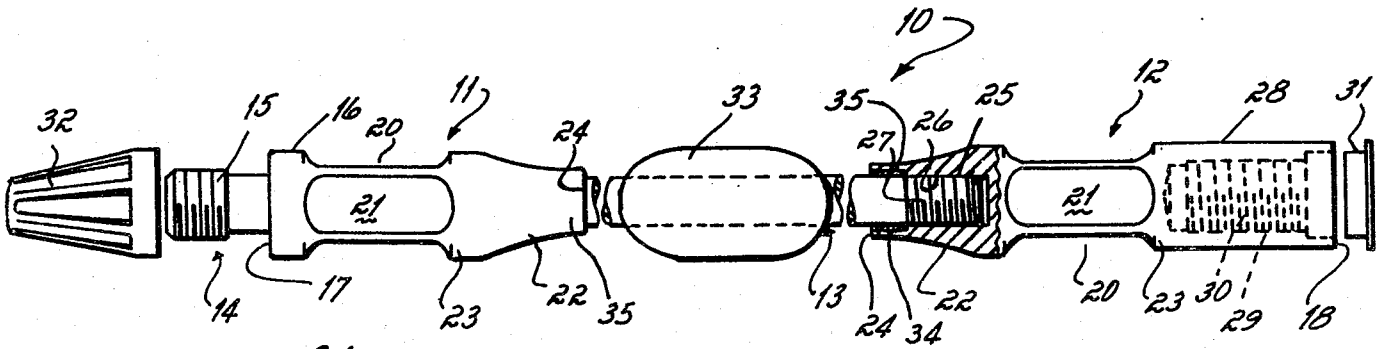
FIG. 1 is an elevational view of an assembled sucker rod having box and pin end portions, which has been partly cut away to reveal the joint between the rod body member and an end portion.

Shown in FIG. 1 is a preferred form of the sucker rod 10 comprising the instant invention. The sucker rod 10 is formed of three principal elements, consisting of two end portions 11 and 12 and an intermediate elongate rod member 13. These three elements are made of cold-drawn medium to high carbon steel rather than hot rolled or forged steel, and the end portions 11 and 12 are machined to API standard dimensions. The employment of cold-drawn steel having a medium to high carbon concentration yields a steel rod material with higher strength and better performance characteristics than hot forged or heat treated stock. Consequently, the rod body member 13 which forms the bulk of the sucker rod's length is of a smaller diameter than a hot rolled rod of equivalent strength and characteristics. For example, a ½" diameter rod body member of cold-drawn steel will replace the standard ⅝" rod body portion made of hot rolled stock. The ability to use a smaller body rod element over the typical 25–30 foot length of most sucker rods yields a significant benefit in increased volume available within the well hole for the passage of oil as well as a consequent downsizing in the size and horsepower of pumping equipment necessary to reciprocate the sucker rod string in the well.

Figure 2:
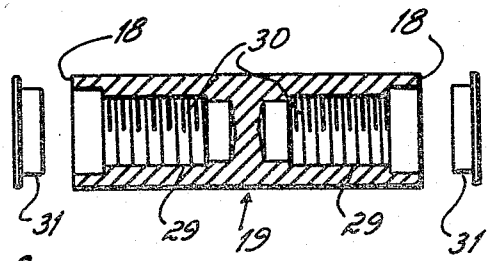
FIG. 2 a cut-away elevational view of a sucker rod coupling element.

The machined end portions of the illustrated sucker rod 10 are of standard form, and consist of a box end 12 and a pin end 11. The pin end is composed of a male shank 14 having roll threads 15. The shank is slightly under-cut intermediate the threads 15 and the pin shoulder 16 to less than the root diameter of the threads to minimize stress concentrations in the threads from the tensional forces to which the sucker rod string is subjected. The pin shoulder 16 has an annular abutting edge surface 17 which is normal to the axis of the sucker rod 10, and which functions in the coupling of sucker rods. The pin shoulder edge surface 17 is adapted to engage the annular surface area 18 of a coupling element 19 (shown in FIG. 2) or a box end element 12 on an adjacent sucker rod in surface-to-surface relation. The annular surface area 18 is also normal to the axis of the sucker rod 10 for this reason. This sealing engagement inhibits the passage of corrosive fluids present in the well into the coupling joint, thus serving to maintain the integrity of the threaded coupling joint.

Progressing longitudinally inwardly along the sucker rod 10 from the pin shoulder 16, a wrench portion 20 is next shown on the end portion 11. This wrench portion or wrench square 20 is provided with two or more flats 21 for the purpose of tightening or torquing the end portions into fixed engagement with the sucker rod body member 13 as well as for coupling the entire assembled sucker rod 10 to a compatible adjacent sucker rod's end portion or a coupling element to make a sucker rod string. The wrench square 20 is set radially inwardly from the pin shoulder 16 and a solid disk portion 23 which is integral with a bead portion 22, the disk portion being of approximately the same width and diameter as the pin shoulder.

Following the wrench portion 20 and the disk portion 23 is a tapered bead or flared portion 22 which is the transition area between the sucker rod body member 13 and the end portion 11. This flared portion 22 tapers radially inwardly from the disk portion 23 to the rod body member 13, and is squared off nearest the rod body member to provide an annular surface 24 which is normal to the longitudinal axis of the end portion 11.

The curve of the taper is non-linear, being of greater slope adjacent the disk portion 23 and of virtually no slope adjacent the annular surface 24. Tapering in this manner serves to prevent wedging of the rod end in the elevator tools typically used in the industry for removing sucker rod strings from wellholes.

As shown in the cut-away segment of end portion 12 in FIG. 1, the tapered bead portion 22 is provided with a centrally located longitudinal bore 25 to approximately the depth of the disk portion 23. The bore 25 has internal threads 26 which are adapted to engage the external roll threads 27 of the rod body member 13. The internal threads 26 begin at a point spaced inwardly from the beginning of the bore 25. An annular gap 34 is provided at the opening of the bore 25 extending approximately 8 mm within the bore 25, the tapered bead portion 22 thus forming a collar 35 in this area. The depth of the gap 34, or alternatively the height of the collar 35, should be approximately 40% of the diameter of the rod body member 13. Threads 27 are provided on the rod body member 13 only to the extent necessary to provide a firm coupling between the rod body member and the end portion, extending partly along the endmost part of the rod body member which is retained within the end portion. In assembly of the sucker rod from its various components, an anaerobic cement is applied to the threads 26, 27 to effect a permanent bond which will minimize stress in the area of the threads, prevent the rod body member 13 and the end portion 11 or 12 from working loose, and also inhibit the entry of corrosive fluids present in the well into this joint.

The bond formed by the anaerobic cement in conjunction with the novel collar 36 reduces the stress typically imposed on the first threads of the threaded engagement in this transition zone. The cement acts as a cushion in this joint area against stress forces imposed on the rod, equalizing or more evenly distributing the load forces in this area, thereby enhancing the fatigue properties of the rod as well as its ultimate strength.

This is a result of the cement's ability to provide a limited amount of flexion of the rod body member 13 within the annular gap 34 while maintaining the integrity of the bond between the rod body member 13 and the collar 35 of the end portion 11. Stress and shear forces which the first threaded engagement would normally be subject to are thus reduced through distribution along the bond formed with the collar 35.

The cement employed cures in the absence of air and in the presence of metal. The particular anaerobic cement that has proven most effective in the practice of this invention is a modified Loctite® 680 adhesive, Loctite® being the registered trademark of the Loctite Corp. Loctite® 680 is readily obtainable in the marketplace, and is a thermoset plastic dimethacrylate of methacrylic ester and maleic acid. It is modified in performance for use in this invention by increasing the percentage of thixotropic agent employed to yield a more viscous cement which has better adhesion properties and is less subject to run-off during application to the joint. A viscosity in the range of 20,000–30,000 centipoise has proven adequate for the practice of this invention.

The pin end portion 11 having been described, attention is now directed to the box end portion 12. As shown in FIG. 1, the box end portion 12 differs from the pin end portion 11 only in the substituion of a cylindrical shaped box end 28 for the male shank 14 and pin shoulder 16. The box end 28 is of even diameter with the pin shoulder 16, and is provided with a central and longitudinal internal bore 29 which is match-threaded with the roll threads 15 of the male shank 14 to receive and fixedly engage the same. The bore is of sufficient depth to receive the male shank to a depth whereby the normal surface 17 of the pin shoulder 16 and the normal surface 18 of the box end 28 come into surface-to-surface contact when two adjacent sucker rods are coupled to form a sucker rod string. As previously noted, this surface-to-surface engagement inhibits the entry of corrosive fluids into the threaded coupling joint.

In all other respects, the box end portion 12 is equivalent in structure to the pin end portion 11, and is secured to the rod body member 13 in the previously described manner.

As illustrated in FIG. 1, the sucker rod 10 is composed of a rod body member 13, a pin end portion 11 and a box end portion 12. A sucker rod need not be limited to the illustrated form, however, and due to the versatility of the multi-component rod of this invention, it can be composed of any combination of end elements disclosed. For example, a sucker rod can be composed of two pin end elements 11 located on either end of the rod body member 13. Such a pin-and-pin sucker rod necessarily requires a coupling element 19 (FIG. 2) to join the assembled sucker rods in a string.

The coupling element 19 is formed of medium to high carbon cold-drawn steel and is machined to API specifications. It is essentially cylindrical on its external surface, but may be provided with flats (not shown) as previously described for the purpose of tightening the coupling element 19 with respect to the sucker rod 10.

The coupling element 19 is provided with two central and longitudinal bores 29 at either end which may extend only part way through and along the longitudinal axis of the coupling element. The bores 29 are match-threaded with the male shank threads 15, and are of sufficient diameter and depth to receive and engage the male shank 14 to a depth sufficient to bring the normal surface 18 into surface-to-surface sealing engagement with the normal surface 17 of the pin shoulder 16. The internal threads 30 of the coupling element 19 do not extend to the ends of the coupling element, but terminate inwardly of the ends.

End caps 31 are provided for both the coupling element 19 and box end portion 12 to protect the internal threads during shipment and manufacture, as is a plastic thread protector 32 which serves a similar purpose for the external threads of the male shank 14.

Paraffin scrapers 33 are provided along the length of the sucker rod body member 13 which function to remove and break up the build-up of paraffin that typically occurs at certain portions of the well hole where paraffin solidifies out of the crude oil as it cools on its way to the surface. These scrapers may be fixedly cemented in place as desired.

It will be appreciated that the use of end caps 31, 32, and scrapers 33 are preferred features of the main embodiments of this invention, and should therefore not be taken as limiting features. Likewise, since various changes and modifications of the invention will occur to and can be readily made without departing from the invention by those skilled in the art, the invention is not to be taken as limited except by the scope of the appended claims.

What is claimed is:

1. A plural element sucker rod comprised of:

an elongate rod having two ends, said elongate rod being formed from cold-drawn steel and comprising the main body member of said sucker rod, two end portions, said end portions being formed from cold-drawn steel, said two end portions being fixedly attached one to each end of said elongate rod and having means thereon for the detachable coupling of said sucker rod into a sucker rod string.

2. The sucker rod of claim 1 wherein said elongate rod is externally threaded at each end, and said end portions are internally match threaded with said external threads, said internal and external threads being in threaded engagement in said sucker rod, and wherein a cement is applied to said threads to bond said threads in threaded engagement and to equalize the load on the first threads, thereby greatly enhancing fatigue properties as well as the ultimate strength of said sucker rod.

3. The sucker rod of claim 2 wherein said positions are provided with a terminal collar, said collar being spaced from said elongate rod on assembly of said sucker rod, said cement when applied filling the space between said elongate rod and said collar.

4. The sucker rod of claim 2 wherein said cement is an anaerobic cement having a viscosity in the range of 20,000–30,000 centipoise.

5. The sucker rod of claim 1 wherein said elongate rod and said two end portions are formed from cold-drawn steel having a medium to high carbon concentration.

6. The sucker rod of claim 5 wherein said sucker rod has a minimum tensile strength of 135,000 PSI.

7. The sucker rod of claim 3 wherein one of said end portions is a pin end portion having an externally threaded shank portion, a substantially cylindrical shank portion longitudinally adjacent and inward of said threaded shank portion, which cylindrical shank portion is slightly radially inwardly under-cut relative to the threaded shank portion, a radially outwardly extending cylindrical shoulder portion longitudinally adjacent and inward of said substantially cylindrical shank portion, a wrench square portion longitudinally adjacent and inward of said cylindrical shoulder portion, said wrench square portion having one or more planar surfaces, and a tapered bead portion longitudinally adjacent and inward of said wrench square portion, said tapered bead portion tapering radially inwardly.

8. The sucker rod of claim 7 wherein said shoulder portion has a planar edge surface normal to and adjacent said cylindrical shank portion.

9. The sucker rod of claim 3 wherein one of said end portions is a box end portion having an internally threaded cylindrical box end, a wrench square portion longitudinally adjacent and inward of said cylindrical box end, said wrench square portion having one or more planar surfaces, and a tapered bead portion longitudinally adjacent and inward of said wrench square portion, said tapered bead portion tapering radially inwardly.

10. The sucker rod of claim 9 wherein said box end has a planar edge surface at its outermost end and normal to its longitudinal axis.

11. The sucker rod of claim 1 wherein both of said end portions are identical, and further comprising:

a coupling element formed of cold-drawn steel, said coupling element having means thereon for joining two sucker rods in end-to-end relationship to form a string.

12. The sucker rod of claim 11 wherein said coupling element is formed of cold-drawn steel having a medium to high concentration of carbon.

13. The sucker rod of claim 11 wherein said identical end portions are pin end portions having externally threaded shanks, said coupling element having at least one internal bore, said bore having internal threads engaging the external threads of pin end portions of consecutive sucker rods in a string.

14. The sucker rod of claim 13 wherein said coupling element has planar edge surfaces at its outermost ends and normal to its longitudinal axis.

15. The sucker rod of claim 11 wherein said identical end portions are box end portions each having an internally threaded bore, said coupling element having pin shank portions at either longitudinal end, said pin shank portions having external threads engaging the internal threads of box end portions of consecutive sucker rods in the string.

16. The sucker rod of claim 9 further comprising:

a hollow plastic cylinder fixedly mounted about said box end, said cylinder serving as a guide for said sucker rod within a well hole and as an abrasion protective element for said box end.

17. The sucker rod of claim 2 wherein said end portions have a terminal collar portion which surrounds said elongate rod and is spaced therefrom on assembly of said sucker rod, said collar portion having a height measured longitudinally along said elongate rod which is about 40% of the diameter of said elongate rod, said cement when applied filling the space between said elongate rod and said collar portion.

18. A sucker rod assembled from plural elements comprised of:

an elongated rod body member having two ends and comprising the main body member of said sucker rod, the two ends being externally threaded, two end portions of a box end or pin end shape, said end portions each having an axially extending bore which is internally match threaded with the external threads of said rod body member for attachment of said end portions to said rod body member ends, said elongated rod body member and said end portions being formed of cold-drawn medium to high carbon steel having a minimum tensile strength of about 135,000 psi.

19. An improved sucker rod assembled from plural elements comprising:

an elongated rod body member having two ends, the two ends being externally threaded, two end portions of a box end or pin end shape, said end portions each having an axially extending bore having internal threads for attachment of said end portions to said rod body ends, a collar on said end portions adjacent the bore opening thereof, said collar surrounding said rod body member and being spaced therefrom on assembly of the sucker rod, and a cement bonding said internal and external threads in engagement, said cement when applied filling the space between said rod body member and said collar.

20. The sucker rod of claim 19 wherein the cement is an anaerobic cement which is semi-flexible under stress and shear forces to which the sucker rod is subjected during normal use.

* * * * *